United States Patent [19]

Gershenson et al.

[11] Patent Number: 4,732,085

[45] Date of Patent: Mar. 22, 1988

[54] SMOKE GENERATION APPARATUS AND PROCESS USING MAGNETIC FIELD

[75] Inventors: Moshe Gershenson, Bronx, N.Y.; Mark L. Moskowitz, Wayne, N.J.

[73] Assignee: GAF Corporation, Wayne, N.J.

[21] Appl. No.: 48,381

[22] Filed: May 11, 1987

[51] Int. Cl.[4] ..... F42B 13/44

[52] U.S. Cl. ..... 102/334; 102/209

[58] Field of Search ..... 102/334, 209, 412

[56] References Cited

U.S. PATENT DOCUMENTS 4,377,113 3/1983 Florence ..... 102/209
4,406,815 9/1983 Magnusson et al. ..... 102/334 X
4,446,794 5/1984 Simmons ..... 102/334 X
4,700,628 10/1987 Varmo ..... 102/334 X

FOREIGN PATENT DOCUMENTS 3521184 12/1986 Fed. Rep. of Germany ..... 102/334

*Primary Examiner*—Peter A. Nelson
*Attorney, Agent, or Firm*—Laughlin, Markensohn, Lagani & Pegg

[57] ABSTRACT

This invention relates to an improved smoke generator. In particular it relates to a method and apparatus for producing dense smoke clouds for camouflage purposes utilizing a solid propellant.

32 Claims, 5 Drawing Figures

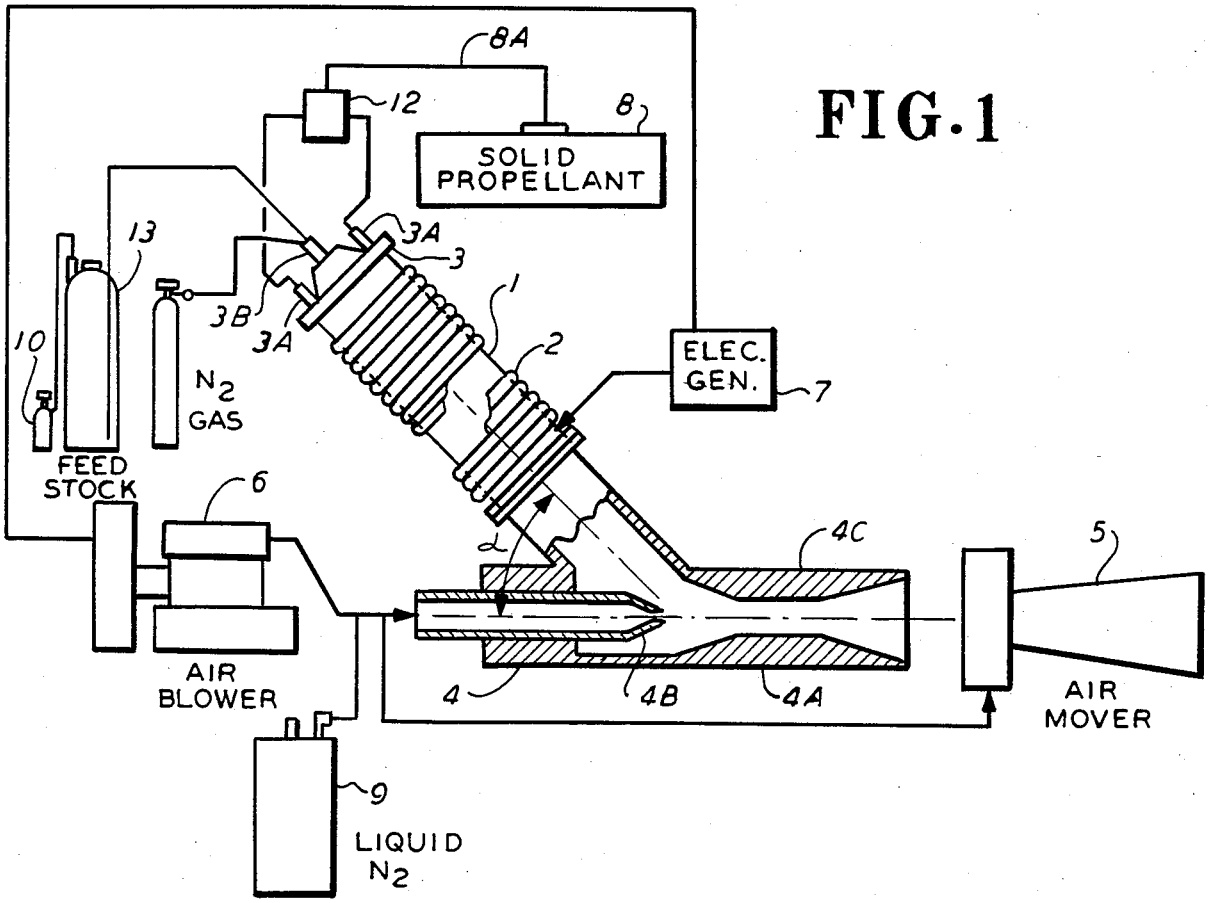
FIG. 1
FIG. 2
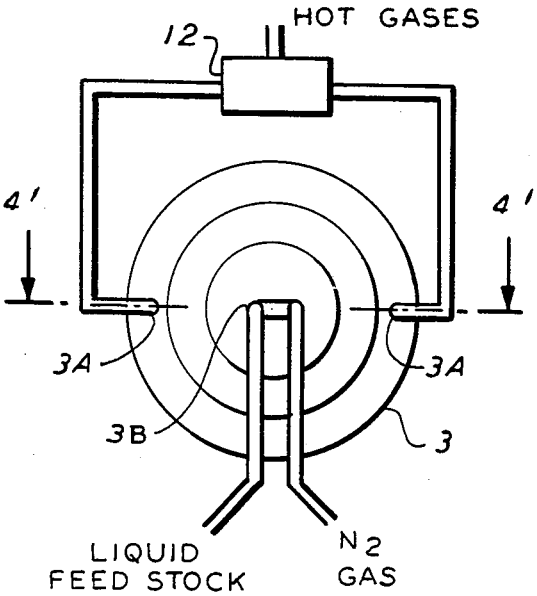
FIG. 3
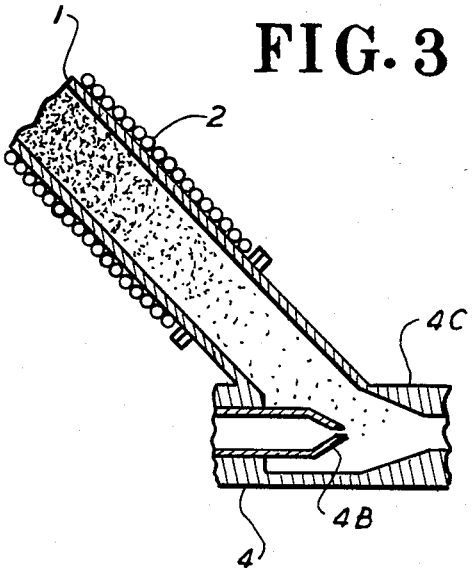

FIG. 5
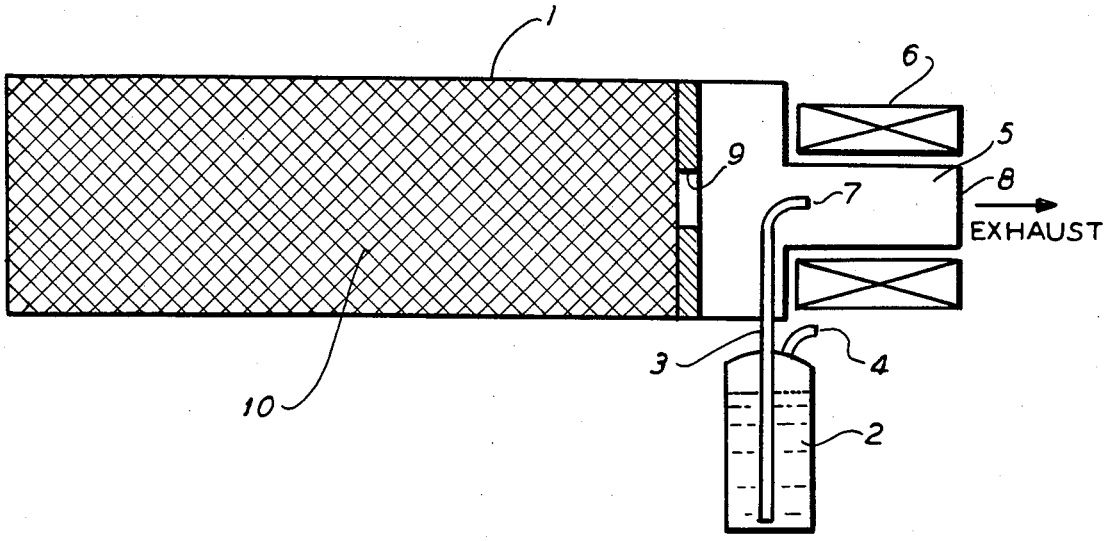
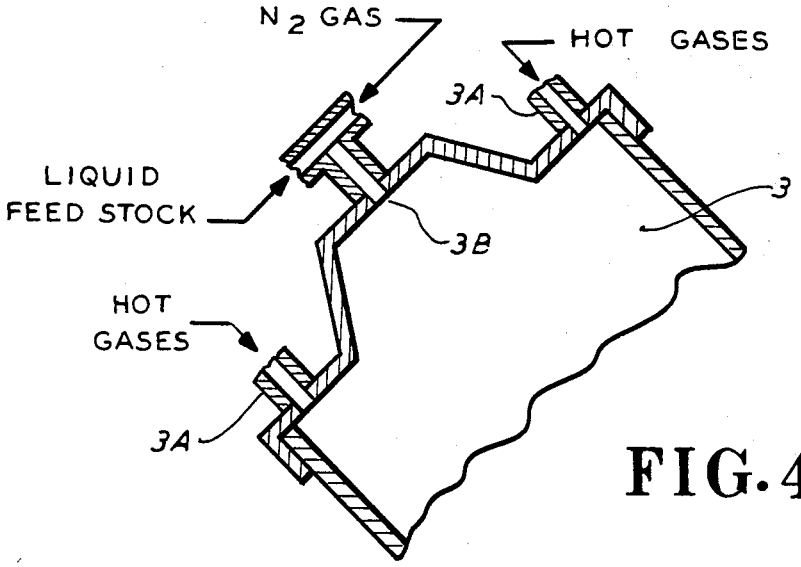
FIG. 4

SMOKE GENERATION APPARATUS AND PROCESS USING MAGNETIC FIELD

FIELD OF THE INVENTION

This invention relates to an improved smoke generator. In particular it relates to a method and apparatus for producing dense smoke clouds for camouflage purposes.

BACKGROUND OF THE INVENTION

Pyrotechnic smoke compositions, based on phosphorus, phosphorus-containing compositions, or HC smoke compositions, used in mortar smoke bodies, generate a fog consisting of finely divide acid droplets or hydroscopic salts, such as zinc chloride, (West German Patent Specification No. 1,185,510, West German Patent Specification No. 1,196,548 and West German Patent Specification No. 1,300,454). Furthermore, it is known to generate fog-clouds by the discharge of strongly hygroscopic acids such as chlorosulphonic acid, or of acid chlorides, such as phosphorus pentachloride or of liquids such as titanium tetrachloride, or of mixtures of the above-mentioned acids, acid chlorides or liquids in combination with amines, such as, for example, triethylamine as disclosed in the West German Unexamined Patent Application (Offenlegunqeschrift) No. 2,232,763. Furthermore, it is known to generate fog-clouds with fine droplets by dispersing oil or oil/water emulsions by means of compressed gas generators.

While fire risk, risk of poisoning by the usually toxic fog, and only low scattering and absorption in the near infra-red range are generally inherent in pyrotechnic fogs, the acid fogs, acid chloride fogs, liquid fogs and two-component fogs, produced from the latter types with amines, possess, apart from only low scattering and absorption in the near infra-red range, the disadvantage of acute chemical attack, corrosion and toxicity. In addition, the oil fogs or oil/water emulsion fogs are completely permeable to the wave length range of the near infra-red light, (0.8 to 14 m). Moreover, it is known from the British Patent Specification 638,060 to produce a stream of solid particles in the form of smoke for coating and finishing purposes.

U.S. Pat. No. 4,210,555 discloses a method for producing smoke for military purposes which allegedly produces smoke which is cold, neutral, non-toxic as well as impermeable to infra-red instruments and other instruments used in military night vision techniques. The smoke is produced by using microfine powder, having a particle diameter of from 3 to 60 μm, being impenetrable to visible light and infra-red light of up to 14 μm wave length, and having a settling velocity of up to 5 cm/sec., which is dispersed in a very short time from a container by means of a propellant gas or explosive. Powders that can be used in practicing the invention of U.S. Pat. No. 4,210,555 are talc, kaolin, ammonium sulfate, ammonium phosphates, calcium carbonates, magnesium carbonates, sodium hydrogen carbonate, and other free-flowing powders, or powders that have been rendered flowable, which can form buoyant clouds upon being dispersed as by discharge of a compressed gas.

By the use of the above-mentioned neutral, cold and nontoxic powders, the disadvantages of toxicity and of fire risk are excluded, as the powder is finely atomized in the cold. It is alleged that the essential advantage, however, is that military night vision techniques, particularly the use of temperature entropy recording instruments, are unable to penetrate the artificial dust cloud and thus are unable to record a temperature entropy diagram of the terrain behind the cloud. Dispersion of the powder can be effected by known methods by means of propellant gas, e.g. $CO_2$, $N_2$ or compressed air, inside or outside the receptacle containing the powder. Similarly, it is also possible to apply as the propellant a gas refrigerant gas or a propellant gas from gas generators. Release or liberation of the compressed gas onto the powder in the container is preferably effected electrically, e.g. by operating a pyrotechnic power element or an electrical-mechanical element.

Ejection of the powder is effected through an atomizerlike device having an ascending tube in the interior of the powder container, such tube ending in a suitable nozzle aperture for the fine division or dispersion of the powder into the surrounding atmosphere. In accordance with the usual technique, separation between the release of compressed gas onto the powder and the efflux of the powder through the nozzle can be accomplished, for example, by means of an additional valve and/or a bursting-disc on the container. In this way, rapid and safe discharge of the fog-cloud is possible.

U.S. Pat. No. 4,406,815 discloses an aerosol which allegedly reduces optical transmission by an attenuation technique which utilizes an aerosol of finely divided particles e.g. activated carbon black. The carbon black has a considerable "micro porosity," that is a small scale porosity with holes having a size less than the optical wave lengths (i.e. $<0.1$ μm). Furthermore the carbon black particles have a very irregular configuration and an absorbing surface of up to 1200 $m^2/g$. Eighty percent of the particles have diameters which are approximately equally distributed in the range between 1 to 9 μm.

U.S. Pat. No. 4,538,151 discloses electro-magnetic wave absorbing material which comprises, inter alia, a mixture of ferrite and a high molecular weight synthetic resin, carbon black and short fibers of metal. The metal fibers preferably have a length (L) of 0.1–50 mm and a length (L) to diameter (D) ratio (L/D) of larger than 10. The quantity of metal fiber is larger than 3% by weight. The metal is a high conductivity metal such as Au, Ag, Cu, Cr, Zn, Ni, Fe or alloys thereof. The ferrite may be substituted by a ferromagnetic material such as iron, cobalt or nickel. The synthetic material can comprise the titanates of lead, barium and strontium as well as lead neobate and lead zirconate.

U.S. Pat. No. 3,773,684 discloses a dipolar electrooptic composition and its method of preparation. Particles which have a dipole moment or exhibit a dipole moment in a magnetic field are suspended in a fluid medium. Illustrative of the dipole particles are herapathite particles and metals. The invention is directed primarily toward reversible effects produced by changing current polarity on fluids having suspended therein particles having a dipole moment.

It is know that smoke useful for camouflage purposes can be prepared by suspending material in a fluid medium, and vaporizing the medium using a heat source while mixing the fluid with an inert carrier gas. Both the suspended particles and the fluid carrier medium which becomes an aerosol, contribute to the "smoke". It is also known to form smoke with suspended particles by decomposing a liquid feedstock to form the particles. Proper selection of the particles, from which radar, infra-red or other electromagnetic waves are absorbed or scattered, results in a smoke opaque to both visible light and other electromagnetic radiation. The disadvantage of the prior art method is that there is a requirement for a large volume source of inert gas. Additionally, a heat source is required to produce steam which is utilized to vaporize the fluid carrier medium in a heat exchanger. An important aspect of the prior art generation process is the use of a magnetic field which aligns the particles of the feed and causes "growth" of the particles to a size to result in optimum obscurant effect of the smoke in the electromagnetic wave range of interest. The smoke produced must be essentially near ambient temperature so that it will not rise as a result of thermal convection.

BRIEF DESCRIPTION OF THE DRAWINGS

FIG. 1 is a schematic of an improved smoke generator;

FIG. 2 is a plan view of the reactor head with nozzles;

FIG. 3 is a cross section of the reaction zone and air injector;

FIG. 4 is a cross section of part of the reactor head along line 4';4' in FIG. 2;

FIG. 5 is a cross sectional view of the simplified smoke generator.

OBJECTS OF THE INVENTION

It is an object of this invention to provide a compact smoke generator which minimizes the need for auxiliary support equipment. It is a further objective of this invention to provide a means for generating smoke which eliminates the need for a large capacity nitrogen supply.

It is a still further object of this invention to provide a method for introducing smoke into a venturi which minimizes breakage of the fragile smoke filaments produced in the reaction chamber of the smoke generator. It is a further object of this invention to eliminate the need for heat exchangers and steam supply for the vaporization of the feedstock utilized in the smoke generation process.

These and other objectives and the advantages of the invention which will be readily apparent to those skilled in the art having access to this disclosure, are accomplished by the apparatus and process disclosed herein.

SUMMARY OF THE INVENTION

It has surprisingly been found that a solid propellant can be used as the source of inert gas in a smoke generation process. In one modification, the hot inert gases serve to vaporize the feedstock utilized into which are dispersed smoke creating particles. In the second modification a liquid feedstock is decomposed to form solid particles. A magnetic field is utilized as in the prior art method to align the magnetically polarizable particles and to cause controlled particle "growth" into filaments.

DETAILED DESCRIPTION OF THE INVENTION

This invention relates to smoke generators. In particular it relates to smoke generators suitable for military use in camouflage operations.

In the practice of this invention a solid fuel propellant is utilized to generate a hot substantially inert carrier gas. The carrier gas comprises $N_2$, $CO_2$, CO, $NH_3$, $H_2$ and minimal amounts of $H_2O$, as well as insignificant amounts of other components. The gas contains no oxygen. A feedstock which comprises a fluid carrier medium is injected into the hot gas stream. It will be appreciated that a fluid carrier while preferred is not essential where other smoke generating particles are injected directly into the inert gas stream.

In the specification and claims, the term "substantially inert" when used with respect to the carrier gas means that the gas is substantially free of oxygen and water and that other components are inert with respect to the fluid carrier medium, if used, and to the other smoke generating particles which are suspended in the fluid carrier or injected directly into the inert carrier gas. For the purpose of illustration, in the drawings, the invention is described in detail with respect to a system utilizing a liquid feedstock which decomposes to form solid particles. However it can also be utilized with a fluid carrier medium into which other smoke generating particles are suspended. It will be appreciated by those skilled in the art having access to this disclosure that smoke generating particles can be atomized directly into the inert carrier gas without utilizing a fluid carrier medium. As used in the specification and claims the term "feedstock" means a fluid which decomposes into smoke forming particles or a fluid medium having dispersed therein other smoke forming materials.

The prior art smoke generating feedstocks are suitable for use in the practice of this invention. One type of feedstock can comprise microfine powders having a particle diameter of about 1 to about 60 $\mu$m, preferably about 2 to about 50 $\mu$m more preferably about 3 to about 40 $\mu$m. Suitable powders useful in smoke generation include talc, kaolin, ammonium sulfate, ammonium phosphate, calcium carbonates, sodium hydrogen carbonate as well as metal powders or metal oxide powders. Illustrative of the metals which can be utilized are iron, copper, aluminum, chromium, ferrous alloys, etc. The oxides of these metals in powder form are similarly useful in the smoke production of this invention. The powders can be used in the neat form or can be dispersed in a fluid carrier. Illustrative of suitable fluid carriers are organic solvents such as hexane, benzene and cyclohexane; oils, including light weight solvent oils of the type produced in isooctane processes and used in dry cleaning processes, e.g. Exxon's ISOPAR L or M, and low viscosity machine oils. The oils can be optionally emulsified in water.

Another type of liquid feedstock is one which decomposes to form particles. Illustrative of this latter type of feedstock suitable for use in the practice of this invention is GAF-SX1 manufactured by GAF Chemicals Corporation, Wayne, N.J.

Illustrative of the solid fuel propellants suitable for use in the practice of this invention are castable ammonium nitrate propellants such as Olin's OMAX 600.

Referring now to FIG. 1, a solid propellant, housed in solid propellant canister, 8, is burned. The gases produced are fed via transfer line, 8A to the carrier gas manifold, 12 and introduced into the reaction chamber, 1 through the inert gas inlet, 3A in the reaction chamber head, 3. The feedstock is fed from the feedstock container, 13 to the atomizing nozzles, 3B by using a source of pressure, 10, e.g. nitrogen gas to pressurize feedstock container, 13.

An electric generator, 7 energizes the electromagnets, 2 which surround the reaction chamber, 1. The flux lines of the electro magnets are parallel to the direction of flow of the gases in the reaction chamber. Particulate matter in the feedstock or that resulting from the decomposition of liquid feedstock, exhibit magnetic polarized behavior in the magnetic field, and as a consequence, are aligned with the flux lines of the magnetic field. The particles line up to form small rods while in the flux field. It will be apparent to those skilled in the art who have access to this disclosure that the strength of the flux field and the time period during which the feedstock particles are within the magnetic field of the reactor must be controlled to avoid gross agglomeration of the particles as distinguished from a controlled agglomeration which results in desirable particles filament growth. The particles generated in the flux field should have a length of 0.5 micrometers up to approximately 5 millimeters and the diameter of each particle is no less than 0.01 micrometers to no more than 25 micrometers.

The flux field must have a strength of at least a threshold value of at least 200 gauss, so as to orient the smoke particles and cause controlled growth. A flux field of about 300 to about 500 gauss is preferred. The smoke particles should be in the magnetic field for a time effective to accomplish the degree of particle filament growth desired.

The smoke particles exit the reaction chamber, 1, and pass into an ejector, 4 comprising a venturi section, 4A an air inlet nozzle. 4B and a venturi, 4C. Air is introduced into the air inlet nozzle from a blower, 6 which is powered by the electric generator, 7. The smoke exits the ejector, 4 and it is preferably further dispersed by means of a second stage air mover, 5, which receives air from the blower, 6. The air introduced to the air inlet nozzle of the second stage air mover, 5, entrains a large volume of ambient air and serves both to cool the smoke and spread out the filaments in the smoke.

In order that the smoke not be dispersed into the atmosphere and lost by thermal convection it must be substantially at ambient temperature. Where the smoke leaving the reaction chamber has not been sufficiently cooled by the air introduced in the ejector, sufficient liquid nitrogen or other cooling material is added for the purpose of cooling. Such material also gives a head of pressure so that it atomizes. The nitrogen can be introduced into the air nozzle, 4A from a liquid nitrogen tank, 9 to cool the smoke to substantially ambient temperature. The nitrogen flow rate is a function of the gas temperature exiting the reaction chamber and the flow rate of the gas. For different feed stocks the nitrogen flow rate is readily determined by monitoring the temperature of the smoke exiting the ejector and adjusting the nitrogen flow rate accordingly. Increased flow rate will result in lower smoke exit temperatures.

Nitrogen or other gas which is fed from a source such as a nitrogen cylinder, 13 to the nozzle, 3B, and as indicated acts both to atomize the feedstock.

To minimize breakage of the fragile filaments produced in the reaction chamber the gas exiting the reaction chamber is introduced into the ejector at an oblique angle, $\alpha$. Preferably $\alpha$ is an oblique angle of about 25° to about 90°; more preferably about 30° to about 50°, e.g. 45°.

While it is possible to control filament growth in the reaction chamber by a combination of magnetic field strength and exposure time of the gas in the field, growth can also be controlled by using a fixed exposure time and varying the field strength with time. Magnetic fields which are interrupted fields, fluctuating fields or moving fields can be utilized.

An interrupted field is produced by turning the power to the electromagnet on and off so that the excitation of the field is interrupted at a controlled frequency. A fluctuating field is generated by varying the excitation voltage over a range from some minimum value sufficient to generate a field strength of at least 200 gauss to some preselected maximum voltage.

A moving magnetic field can be generated by dividing the electromagnet into a multiplicity of sections. The excitation current is turned on in a first section for a preselected time interval. At the point at which it is turned off the excitation voltage to a second following section is turned on. In this way the field will be cause to move along the reaction chamber axially in the same direction of the gas flow.

In one embodiment, the field is caused to move along the reaction chamber at the same speed as the smoke particle flow. In another embodiment of the invention the magnetic field is both moving and fluctuating. This is accomplished by having the voltage is subsequent sections fluctuating out of phase with one another. For example, the voltage in the first, third and each subsequent odd numbered section can be in phase with one another, while the voltage in the second section is out of with the voltage in the first section, but in phase with the voltage in each subsequent even numbered section. Similarly the fluctuating voltage can be controlled so that when the voltage in the first section is at about one-half of its maximum value the voltage in the second section is at its minimum value, and when the voltage in the first section has reached its maximum value the voltage in the third section is at its minimum value. This sequence can be repeated down the length of the reaction chamber.

By using a solid propellant inert gas source it is possible to simplify the smoke generating apparatus. Referring now to FIG. 5, a solid propellant canister, 1, houses a suitable solid propellant, 10, which when ignited delivers inert gas through orifice, 9, into a combustion chamber, 5. Feedstock is fed from a feedstock container, 2, using a pressure source, 4, to pump feedstock through delivery tube, 3, into nozzle, 7, which atomizes the feedstock. Liquid nitrogen is fed into the combustion chamber to cool the smoke generated. The nitrogen and atomized particles move through an exhaust nozzle, 8, which is within a magnetic field generated by electromagnet, 6, powered by an external power source (not shown).

Although the cooling medium is indicated as nitrogen in the description, as is apparent, any suitable cooling system can be used. Typical carbon dioxide is a suitable material. The description of the invention also indicates the use of a venturi. It should be understood that any type of apparatus can be utilized which accelerates the flow to produce the venturi effect.

The advantages of the simplified smoke generator are readily apparent. It is portable and requires only a source of nitrogen and a source of power for the electromagnets. While specific examples of the invention are disclosed, it is not intended that the scope of the invention be limited to the embodiments disclosed, but it is intended to encompass within the scope of the claims appended hereto variations thereof which utilize the spirit of the invention, which will be apparent to those skilled in the art having access to this disclosure.

What is claimed is:

1. A method for generating smoke for use in military camouflage purposes which comprises injecting a feedstock through an atomizing nozzle into a substantially inert carrier gas stream, said inert carrier gas being the combustion product of a solid propellant fuel, passing the gas stream containing the automized feedstock into a reaction chamber, said reaction chamber being within a magnetic field having flux lines parallel to the flow of the gas stream, said gas stream remaining in the magnetic field for a time sufficient to cause growth of filaments of smoke particles, introducing the gas stream into an ejector wherein the gas stream is mixed with air and exits through a venturi type nozzle into the atmosphere.

2. The process according to claim 1 wherein the filaments have a length of from about 0.5 micrometers to 5 millimeters and a diameter of from about 0.01 to 25 micrometers.

3. The process according to claim 1 wherein a secondary means for further dispersing the smoke into the atmosphere is utilized.

4. The process according to claim 1 wherein the smoke generated is cooled in the ejector by introducing liquid cooling medium into the ejector.

5. The process according to claim 1 wherein a feedstock comprising a fluid carrier medium and smoke generating particles dispersed therein is utilized to generate smoke.

6. The process according to claim 1 wherein a feedstock which decomposes to yield solid particles is utilized to generate the smoke.

7. The process according to claims 5 or 6 wherein the smoke generating particles comprise particles which absorb or scatter electromagnetic radiation.

8. The process according to claim 7 wherein the smoke generating particles absorb or scatter electromagnetic radiation in the radar wave length range.

9. The process according to claim 7 wherein the smoke generating particles absorb or scatter infra-red electromagnetic radiation.

10. The process according to claim 1 wherein air is introduced into the ejector in an axial direction with respect to the ejector and the gas stream leaving the reaction chamber is introduced into the ejector at an oblique angle to the flow of the air steam.

11. The process according to claim 10 wherein the oblique angle an is angle of about 25° to about 90°.

12. The process according to claim 10 wherein the oblique angle is an angle of about 30° to about 50°.

13. The process according to claim 1 wherein the magnetic field is a constant field of unvarying strength.

14. The process according to claim 1 wherein the magnetic field is a fluctuating magnetic field.

15. The process according to claim 1 wherein the magnetic field is an interrupted magnetic field.

16. The process according to claim 1 wherein the magnetic field is a moving magnetic field moving in the direction of flow of the gases in the combustion chamber.

17. The process according to claim 15 wherein the moving magnetic field is an interrupted magnetic field.

18. The process according to claim 15 wherein the moving magnetic field is a fluctuating magnetic field.

19. A smoke generator comprising:

(a) a solid fuel propellant canister;

(b) an elongated reaction chamber having an electromagnet surrounding the reaction chamber, said electromagnet being spatially oriented and energized so as to produce a magnetic field having flux lines which are parallel to the axis of the reaction chamber, said reaction chamber having an open end and a closed end., said closed end having a head having mounted thereon at least one atomizing nozzle for introducing feedstock to the reaction chamber, at least one solid fuel combustion product introduction port, and at least one inert gas feed inlet, means for transferring fuel propellant combustion product to the introduction port, the flow of feedstock and combustion product in the reaction chamber being in an axial direction toward the reaction chamber outlet;

(c) a feedstock storage container having pressurizing means for transferring feedstock to the reaction chamber, and a feedstock transfer line connecting the container to the atomizing nozzle;

(d) an air blower;

(e) an ejector means comprising an air inlet nozzle, a venturi type nozzle and a smoke outlet, said air inlet nozzle being fed with air from the air blower through an air transfer means, said air being directed in an axial direction through the venturi, the combustion chamber and ejector means being interconnected and spatially oriented to one another so that combustion product and feedstock exiting the reaction chamber is introduced into the ejector at an oblique angle to the axial flow of air through the ejector;

(f) a cooling medium for reducing the temperature of the smoke;

(g) a secondary air mover for accelerating and dispersing smoke generated into the atmosphere, said secondary air mover receiving air from the air blower through a connecting transfer line; and (h) an electrical energizing means for exciting the electromagnet and energizing the air blower.

20. The smoke generator according to claim 19 wherein the oblique angle an is angle of about 25° to about 90°.

21. The smoke generator according to claim 19 wherein the oblique angle is an angle of about 30° to about 50°.

22. The smoke generator according to claim 18 wherein the electromagnet comprises a multiplicity of sections, each section of the electromagnet being independently energized.

23. The smoke generator according to claim 22 wherein each section of the electromagnet is independently energized by a continuously interrupted energizing means, thereby resulting in a continuously interrupted magnetic field.

24. The smoke generator according to claim 22 wherein each section of the electromagnet is independently energized by a continuously fluctuating energizing means, thereby resulting in a continuously fluctuating magnetic field.

25. The smoke generator according to claim 23 wherein each section is energized sequentially beginning with a section at the closed end of the chamber, thereby causing the magnetic field to move along the reaction chamber toward the chamber outlet.

26. The smoke generator according to claim 24 wherein each section is energized sequentially beginning with a section at the closed end of the chamber, thereby causing the magnetic field to move along the reaction chamber toward the chamber outlet.

27. A smoke generator comprising a solid propellant canister containing a solid propellant which when ignited produces a substantially inert gas, said canister having integral therewith a combustion chamber connected to an exhaust nozzle, means for introducing a smoke generating feedstock through an atomizing nozzle, into the exhaust nozzle, a cooling medium source connected to the combustion chamber for cooling the inert gas as it is introduced into the combustion chamber, means for generating a magnetic field with the exhaust nozzle, said magnetic field having flux lines parallel to the flow of the smoke generated passing through the nozzle, the combined strength of the magnetic field and exposure of the smoke to the field being effective to cause a controlled growth of smoke particles to form rod-like filaments without substantial agglomeration of the smoke particles.

28. The smoke generator according to claim 27 wherein the electromagnet comprises a multiplicity of sections, each section of the electromagnet being independently energized.

29. The smoke generator according to claim 28 wherein each section of the electromagnet is independently energized by a continually interrupted energizing means, thereby resulting in a continually interrupted magnetic field.

30. The smoke generator according to claim 28 wherein each section of the electromagnet is independently energized by a continuously fluctuating energizing means, thereby resulting in a continuously fluctuating magnetic field.

31. The smoke generator according to claim 29 wherein each section is energized sequentially beginning with a section at the closed end of the chamber, thereby causing the magnetic field to move along the reaction chamber toward the chamber outlet.

32. The smoke generator according to claim 30 wherein each section is energized sequentially beginning with a section at the closed end of the chamber, thereby causing the magnetic field to move along the reaction chamber toward the chamber outlet.

* * * * *